US008499838B2

(12) United States Patent
Fraser et al.

(10) Patent No.: US 8,499,838 B2
(45) Date of Patent: Aug. 6, 2013

(54) SUBSEA LOCKING CONNECTOR

(75) Inventors: Thomas A Fraser, Spring, TX (US); John G Landthrip, Katy, TX (US); Eric D Larson, Tomball, TX (US); Sara N Riddle, Houston, TX (US); Dale Norman, Spring, TX (US); Jamie C Gamble, Houston, TX (US); Satish N Ramasheshaiah, Houston, TX (US); James R Reams, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 55 days.

(21) Appl. No.: 12/975,100

(22) Filed: Dec. 21, 2010

(65) Prior Publication Data

US 2012/0006555 A1 Jan. 12, 2012

Related U.S. Application Data

(60) Provisional application No. 61/362,960, filed on Jul. 9, 2010.

(51) Int. Cl.
*E21B 7/12* (2006.01)

(52) U.S. Cl.
USPC ..... 166/338; 166/341; 166/345; 166/363; 166/85.4

(58) Field of Classification Search
USPC ..... 166/363, 364, 85.4, 86.2, 86.1
See application file for complete search history.

(56) References Cited

U.S. PATENT DOCUMENTS

| | | | | |
|---|---|---|---|---|
| 2,962,096 | A | 11/1960 | Knox | |
| 3,325,190 | A | 6/1967 | Eckert et al. | |
| 3,693,714 | A * | 9/1972 | Baugh | 166/348 |
| 3,820,600 | A | 6/1974 | Baugh | |
| 3,841,665 | A | 10/1974 | Capot | |

(Continued)

FOREIGN PATENT DOCUMENTS

| | | | |
|---|---|---|---|
| GB | 1374712 | A | 11/1974 |
| GB | 2443776 | | 5/2008 |
| WO | 9823845 | A1 | 6/1998 |
| WO | 03048512 | A1 | 6/2003 |

OTHER PUBLICATIONS

Search Report from corresponding GB Application No. GB1111506.0 dated Sep. 2, 2011.

(Continued)

*Primary Examiner* — Matthew Buck
*Assistant Examiner* — Aaron Lembo
(74) *Attorney, Agent, or Firm* — Jayne C. Piana

(57) ABSTRACT

A connector is lowered onto and secured to a subsea member, effecting a seal between subsea member and the connector. The connector includes an outer body defining a cavity, and an inner body defining a bore, wherein the lower end of the inner body resides within the cavity. The connector also includes an engaging member coupled to the outer body and adapted to engage the subsea device, the engaging member radially movable between a disengaged position and an engaged position. The connector includes a seal carried by the inner body and adapted to form a seal between the bore and the subsea device. Finally, the connector includes a pre-loading member coupled to the outer body, operable to urge the inner body and seal against the subsea device to exert a pre-loading force on the seal. A differential pressure between the bore and a subsea environment energizes the seal.

15 Claims, 8 Drawing Sheets

U.S. PATENT DOCUMENTS

| | | | | |
|---|---|---|---|---|
| 4,057,267 | A | 11/1977 | Jansen, Jr. | |
| 4,427,072 | A * | 1/1984 | Lawson | 166/345 |
| 4,433,859 | A | 2/1984 | Driver et al. | |
| 4,526,406 | A * | 7/1985 | Nelson | 285/18 |
| 4,595,053 | A * | 6/1986 | Watkins et al. | 166/209 |
| 4,856,594 | A | 8/1989 | Jennings | |
| 4,902,044 | A | 2/1990 | Williams et al. | |
| 5,433,274 | A | 7/1995 | Graff et al. | |
| 6,035,938 | A | 3/2000 | Watkins | |
| 6,129,149 | A | 10/2000 | Beall | |
| 6,328,343 | B1 | 12/2001 | Hosie et al. | |
| 6,330,918 | B1 | 12/2001 | Hosie et al. | |
| 6,510,897 | B2 * | 1/2003 | Hemphill | 166/373 |
| 6,698,800 | B2 * | 3/2004 | Spiering et al. | 285/261 |
| 7,337,848 | B2 | 3/2008 | Fraser et al. | |
| 2003/0168857 | A1 * | 9/2003 | Jennings | 285/322 |
| 2009/0308658 | A1 | 12/2009 | Larson et al. | |
| 2010/0024907 | A1 | 2/2010 | Tibbitts | |
| 2012/0000664 | A1 | 1/2012 | Nas et al. | |

OTHER PUBLICATIONS

Search Report from corresponding GB Application No. GB1111504.5 dated Sep. 26, 2011.
U.S. Appl. No. 13/038,044, filed Mar. 1, 2011.
U.S. Appl. No. 12/975,080, filed Dec. 21, 2010.
Office Action mailed on Oct. 24, 2012, in patent application with U.S. Appl. No. 12/975,080, 26 pages.

* cited by examiner

SUBSEA LOCKING CONNECTOR

This application claims the benefit of U.S. Provisional Application No. 61/362,960, filed on Jul. 9, 2010, entitled "Made-Up Flange Locking Cap," which application is hereby incorporated herein by reference.

FIELD OF THE INVENTION

This invention relates in general to a connector for deploying subsea to connect to a subsea device.

BACKGROUND OF THE INVENTION

In subsea drilling operations, drilling operators generally use subsea connectors to join risers or other devices to the wellhead. Typically, these devices rely on an externally applied mechanical force to energize a seal between the connector and the joined device. While these mechanically set seals initially hold quite well, during the course of operation differential pressures between an internal bore shared by the devices and the subsea environment can stress or strain the seal, causing the seal to fail.

In addition, during energization, the differential pressure may cause movement of the connector relative to the subsea device that the connector connects to. When this occurs, the seal may not set properly, allowing leakage into or out of the connector. This leakage can further stress or strain the seal causing it to fail earlier than anticipated. Application of additional external mechanical force to further energize the seal may overcome this problem, but it is impractical to continually apply an external mechanical force to the connector to maintain the seal.

Therefore, there is a need for a connector that can be used in subsea environments that overcomes the problems sealing in subsea differential pressure environments.

SUMMARY OF THE INVENTION

These and other problems are generally solved or circumvented, and technical advantages are generally achieved, by preferred embodiments of the present invention that provide a subsea locking cap, and a method for using the same.

In accordance with an embodiment of the present invention, a connector for connecting to a subsea device having an axis comprises an outer body defining a cavity, and an inner body defining a bore, wherein the lower end of the inner body resides within the cavity. The connector further comprises an engaging member coupled to the outer body and adapted to engage a first surface of the subsea device, the engaging member being radially movable between an outward, disengaged position and an inward, engaged position. A seal is carried by the inner body and adapted to form a seal between the bore and the subsea device. Finally, the connector comprises a pre-loading member coupled to the outer body, the pre-loading member being operable to engage a second surface of the subsea device and urge the inner body and seal against the subsea device to exert a pre-loading force on the seal. A substance pressure within the bore energizes the seal.

In accordance with an another embodiment of the present invention, an apparatus for connecting to a subsea member comprises a body defining a bore having an axis. The apparatus also comprises a seal carried by the body. The seal comprises a coupler ring coupled to a lower rim of the body and a sealing ring coupled to the body by the coupler ring. The sealing ring moves along the axis relative to the body in response to a pressure in the bore, thereby energizing the seal.

In accordance with still another embodiment of the present invention, a method for connecting to a subsea device comprises providing a connector with an outer body defining a cavity, and an inner body defining a bore, wherein the lower end of the inner body resides within the cavity. The connector has an engaging member coupled to the outer body and a seal carried by the inner body. Finally, the connector has a pre-loading member coupled to the outer body. The method also comprises lowering the connector toward the subsea member and inserting an end of the subsea member into the cavity. Then the method continues with the step of energizing the engaging member to engage the subsea member. The method concludes with the steps of energizing the pre-loading member to engage the inner body, exerting a preload force on the seal and pressure energizing the seal throughout the life of the connector.

An advantage of a preferred embodiment of the present invention is that the apparatus connects to a subsea member and uses a differential pressure to energize the seal, thereby maintaining the energiziation of the seal.

BRIEF DESCRIPTION OF THE DRAWINGS

So that the manner in which the features, advantages, and objects of the invention, as well as others which will become apparent, are attained and can be understood in more detail, more particular description of the invention briefly summarized above may be had by reference to the embodiments thereof that are illustrated in the appended drawings that form a part of this specification. It is to be noted, however, that the drawings illustrate only certain preferred embodiments of the invention and are therefore not to be considered limiting of the invention's scope as the invention may admit to other equally effective embodiments.

DETAILED DESCRIPTION OF THE INVENTION

The present invention will now be described more fully hereinafter with reference to the accompanying drawings that illustrate embodiments of the invention. This invention may be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning drilling unit operation, materials, and the like have been omitted inasmuch as such details are not considered necessary to obtain a complete understanding of the present invention, and are considered to be within the skills of persons skilled in the relevant art.

Figure 1:
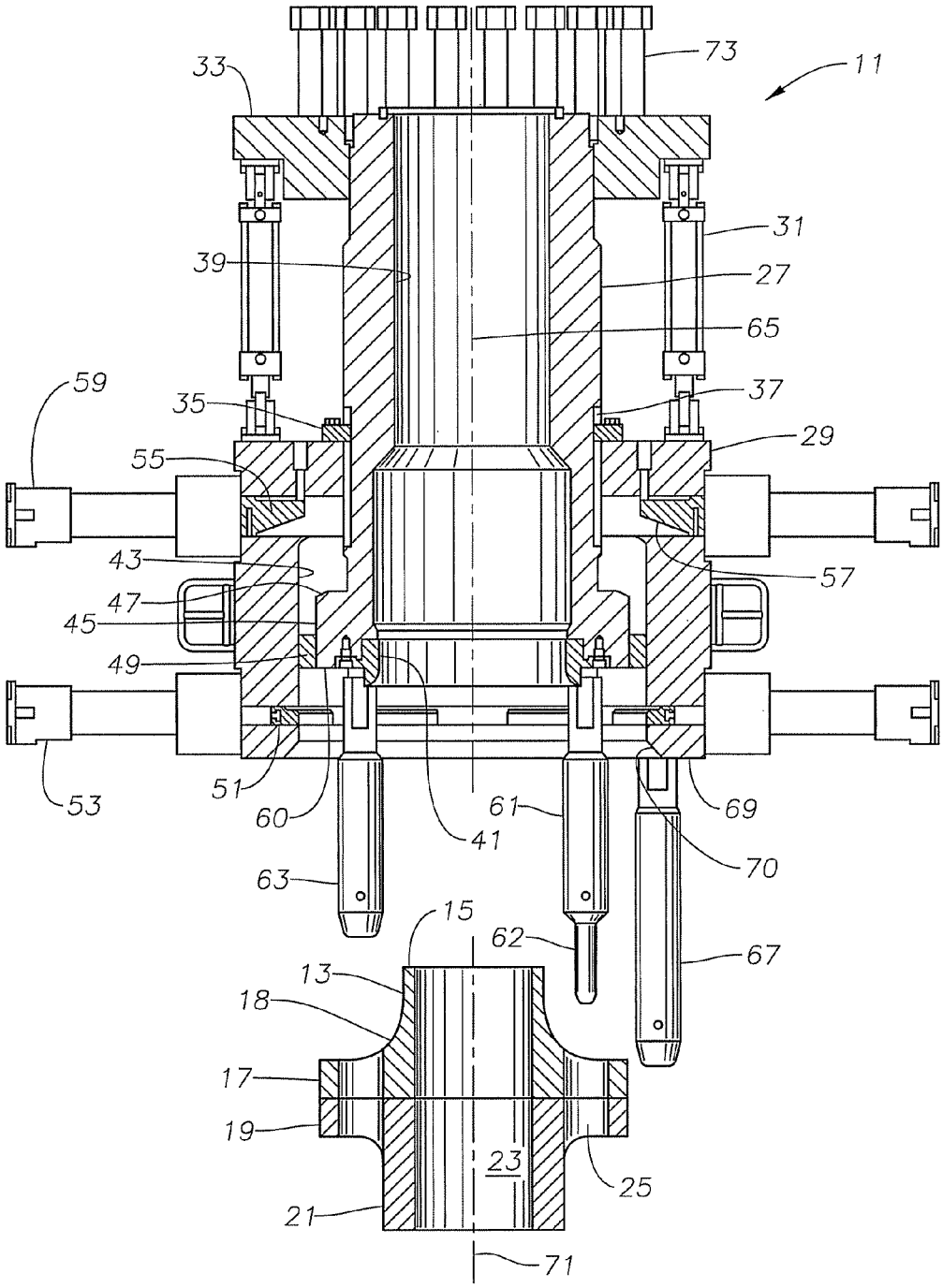
FIG. 1 is a vertical sectional view of a connector in accordance with this invention, shown being lowered onto a vertically-oriented made-up flange.

Referring to FIG. 1, connector assembly 11 is shown positioned over a made-up flange, which in this example comprises a lower riser connector 13. Lower riser connector 13 is a lower portion of a drilling riser (not shown) that normally would extend to a floating vessel at surface. The riser has been damaged and severed from lower riser connector 13 by a cut 15 on the upper end of the lower riser connector 13. Lower riser connector 13 has a curved surface 18 that tapers in a downward direction to a riser flange 17 having a flat upper surface. Curved surface 18 is a curved frusto-conical surface.

In this example, lower riser connector 13 mounts on top of a blowout preventer 21 (BOP), the upper end of which is shown. BOP 21 has a BOP flange 19, and riser flange 17 bolts to BOP flange 19 by a series of bolts (not shown in FIG. 1). BOP 21 and lower riser connector 13 have a mating central passage 23 for drilling fluids and tools to pass through. The mating flanges 17 and 19 preferably have at least two holes 25 that do not contain bolts. The bolts from holes 25 may have been removed, or holes 25 may have originally been left open for another purpose, such as allowing fluid lines to pass through. In this example, holes 25 are spaced 180 degrees apart from each other, but other circumferential spacings between holes 25 may be employed. A person skilled in the art will understand that lower riser connector 13 and BOP 21 could alternatively be another type of connection point. Connector assembly 11 can then connect using a seal as described below with respect to FIG. 2E.

Connector assembly 11 includes an inner body 27 and an outer body 29, both being cylindrical, tubular members. A plurality of lifting devices, such as hydraulic cylinders 31, extend between outer body 29 and a bracket 33 attached to an upper end of inner body 27. When energized, hydraulic cylinders 31 will stroke inner body 27 and outer body 29 relative to each other from a contracted position to an extended position. Outer body 29 is in its upper position relative to inner body 27 in FIG. 1. A person skilled in the art will understand that other devices and methods, such as remotely operated screw lifts, for moving inner body 27 and outer body 29 relative to each other are contemplated and included in this invention. Likewise, methods that do not require motion between inner body 27 and outer body 29 may be used, for example, inner body 27 and outer body 29 may comprise a single unit.

Inner body 27 has a lower portion that locates within a cavity 43 of outer body 29. The lower portion of inner body 27 includes a flange 45 that extends radially outward from the exterior of inner body 27. Flange 45 has an upward facing shoulder 47. Upward facing shoulder 47 may be beveled as illustrated in FIG. 1 or, alternatively, a horizontal surface. A bushing or guide member 49 may be mounted to the outer diameter of flange 45 for sliding along the inner diameter of cavity 43. In the example shown, the lower rim of inner body 27 is still recessed within outer body 29 when outer body 29 is in its upper position. A stop member 35 mounted on the upper end of outer body 29 serves to limit the axial movement of inner and outer bodies 27, 29 between the extended and retracted positions. Stop member 35 may be a portion of a ring that engages a recess 37 formed in the exterior of inner body 27, or it may be other devices.

Inner body 27 has a bore 39 with a seal 41 mounted at the lower end. Seal 41 has a curved lower portion for sealing against curved portion 18 of lower riser connector 13. Seal 41 may be a variety of configurations and materials. FIGS. 2A-2D show four embodiments for seal 41. Each embodiment includes a metal body 32, such as of steel, defining one or more recesses 42, a flange 34 for securing to inner body 27, and one or more inner body seal members 44 for sealing seal 41 against inner body 27. A person skilled in the art will understand that alternative embodiments contemplate and include seal 41 without recesses 42 and inner body seal members 44. Likewise, a person skilled in the art will understand that alternative embodiments contemplate and include use of elastomerics, soft metals, and the like, to construct inner body seal members 44. Inner body seal members 44 may also comprise taper sealing surfaces, flat sealing surfaces, or the like rather than curved sealing surfaces.

Figure 2A:
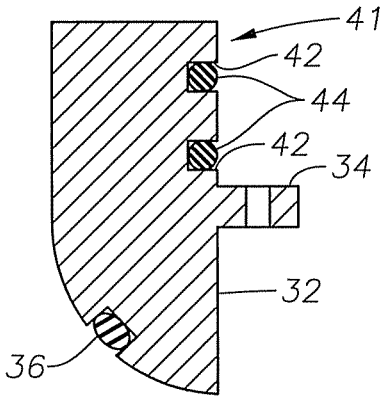
FIGS. 2A-2E are sectional views of alternate embodiments of a seal of the connector of FIG. 1.
Figure 2B:
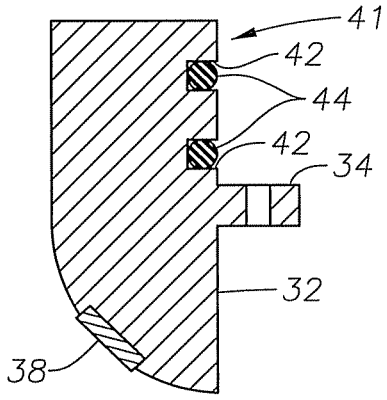
Figure 2C:
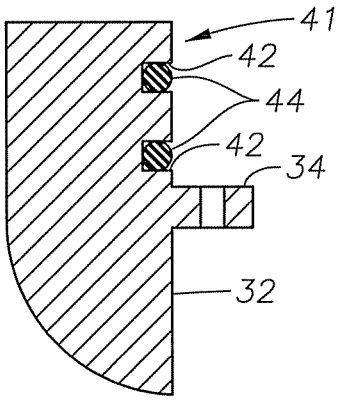
Figure 2D:
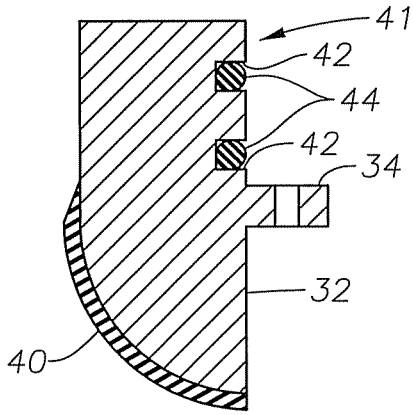

In FIG. 2A, an elastomeric seal member 36, formed of a material such as rubber, is located in a groove in the lower portion of body 32 for sealing against curved surface 18. In FIG. 2B, seal 41 has an inlay 38 of a soft metal on the lower portion for metal-to-metal sealing. In FIG. 2C, the entire lower portion is of the same steel material as body 32 for forming a metal-to-metal seal. In FIG. 2D, seal 41 has an elastomeric layer 40 bonded to its lower portion for forming a seal. Other variations may include an inflatable seal 41.

Preferably, flange 34 loosely couples to inner body 27. As illustrated in FIG. 2A, elastomeric seal member 36 defines an annular member substantially filling the groove in the lower portion of body 32. When placed within the groove of body 32, elastomeric seal member 36 provides a different inner diameter of body 32 than that of body 32 without the groove. Preferably, the inner diameter of the combined elastomeric seal member 36 and body 32 is less than that of body 32 at that location without the groove. Similarly, inner body seal members 44 define annular members substantially filling recesses 42. When placed within recesses 42, inner body seal members 44 provide a different outer diameter of body 32 than that of body 32 without recesses 42. Preferably, the combined outer diameter of the combined inner body seal members 44 and body 32 is greater than the outer diameter of body 32 without recesses 42 at the location of recesses 42.

Following placement and engagement of connector assembly 11, described in more detail below, an initial seal is created between the curved surface of body 32, elastomeric seal member 36, inlay 38, or elastomeric layer 40, and the curved surface 18 of lower riser connector 13. As fluid passes through mating central passage 23 and into bore 39, the fluid pressure within mating central passage 23 and bore 39 cause axial movement of connector assembly 11, generally axially away from lower riser connector 13. As connector assembly 11 moves, loosely coupled seal 41 will float axially relative to connector assembly 11. As connector assembly 11 pulls axially away from lower riser connector 13, seal 41 will remain in contact with lower riser connector 13 and curved surface 18 of lower riser connector 13. Inner body seal members 44 maintain a seal with inner body 27, while allowing a small gap to develop between the portion of body 32 axially above the upper inner body seal 44 and inner body 27. The fluid pressure then fills the small gap and pushes body 32 radially inward and further against lower riser connector 13 and curved surface 18 of lower riser connector 13. In this manner, the fluid pressure within bore 39 further sets seal 41, increasing the ability to seal during operational use of connector assembly 11.

Figure 2E:
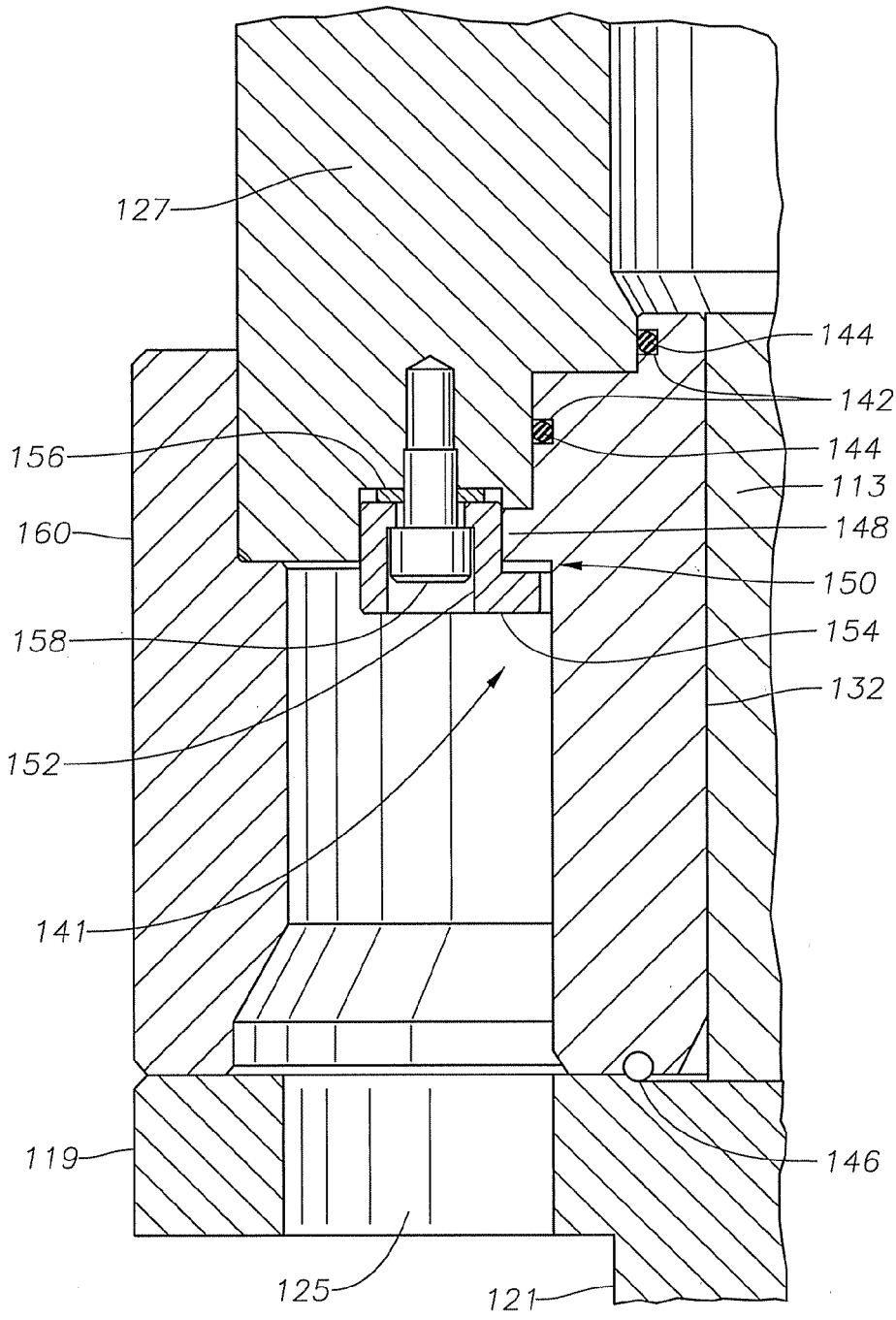

Referring now to FIG. 2E, there is shown an alternative embodiment of seal 41 for connecting to lower riser connector 13 that does not have riser flange 17 awl thus curved surface 18 secured to it. As shown in FIG. 2E, a lower riser connector 113 is a lower portion of a drilling riser (not shown) that normally would extend to a floating vessel at surface. In this example, lower riser connector 113 mounts on top of a blowout preventer 121 (BOP), the upper end of which is shown. BOP 121 has a BOP flange 119. BOP 121 and lower riser connector 113 have a mating central passage for drilling fluids and tools to pass through similar to that of mating central passage 23 and central bore 39 of BOP 21 and lower riser connector 13 of FIG. 1. BOP flange 119 preferably has at least two holes 125 that do not contain bolts, only one of which is shown in FIG. 2E.

In the illustrated embodiment of FIG. 2E, a seal 141 couples to an inner body 127 of a connector assembly. The connector assembly comprises an alternative embodiment of connector assembly 11 having a seal 141 configured to connect to lower riser connector 113 and BOP flange 119. The connector assembly lands on, seals, and energizes as described below with respect to connector assembly 11 of FIGS. 3-11.

Seal 141 has a metal body 132, such as of steel, and a retainer ring 152. Metal body 132 has an inner diameter surface configured to fit flush against an exterior surface of lower riser connector 113. Metal body 132 also defines one or more recesses 142, an outer flange 148, and one or more inner body seal members 144 for sealing seal 141 against inner body 127. A person skilled in the art will understand that alternative embodiments contemplate and include seal 141 without recesses 142 and inner body seal members 144. Likewise, a person skilled in the art will understand that alternative embodiments contemplate and include use of elastomerics, soft metals, and the like, to construct inner body seal members 144. Inner body seal members 144 may also comprise tapered sealing surfaces, flat sealing surfaces, or the like rather than curved sealing surfaces. An elastomeric seal member 146, formed of a material such as rubber, is located in a groove in the lower portion of body 132 for sealing against an upper surface of BOP flange 119.

Seal retainer ring 152 comprises a U-shaped ring defining an inner flange 154 near a lower end of seal retainer ring 152 proximate to metal body 132. Seal retainer ring 152 couples to a lower rim of inner body 127 by bolt 158. Interposed between seal retainer ring 152 and the lower rim of inner body 127 is a spacing washer 156 of a thickness such that a gap 150 will exist between inner flange 154 and outer flange 148. Preferably, gap 150 allows seal 141 of FIG. 2E to float similar to seal 41 of FIGS. 2A-2D. Also coupled to inner body 127 is a deflection spacer 160 configured to limit the compression of seal 141 to a predetermined amount. During placement and engagement, described with respect to connector assembly 11 in more detail below, seal 141 is placed under axial compression by a pre-loading force, deflection spacer 160 limits the total axial compression of seal 141 during pre-loading to a predetermined amount selected for the particular application.

As illustrated in FIG. 2E, elastomeric seal member 146 defines an annular member substantially filling the groove in the lower portion of body 132. When placed within the groove of body 132, elastomeric seal member 146 extends the axial length of body 132 over that of body 132 without the groove. Similarly, inner body seal members 144 define annular members substantially filling recesses 142. When placed within recesses 142, inner body seal members 144 provide a different outer diameter of body 132 than that of body 132 without recesses 142 at the location of recesses 142. Preferably, the combined outer diameter of the combined inner body seal members 144 and body 132 is greater than the outer diameter of body 132 without recesses 142 at the location of recesses 142.

Following placement and engagement of the connector assembly, described with respect to connector assembly 11 in more detail below, an initial seal is created between the surface of body 132, elastomeric seal member 136 and an upper surface of BOP flange 119. As fluid passes through the mating central passage and into the bore, the fluid pressure within the mating central passage and the bore cause axial movement of the connector assembly, generally axially away from lower riser connector 113. As the connector assembly moves, gap 150 allows seal 141 to float axially relative to the connector assembly. That is, inner body 127 can move axially relative to seal body 132 an amount equal to the axial dimension of gap 150. As the connector assembly pulls axially away from lower riser connector 113, seal 141 will remain in contact with lower riser connector 113 and BOP flange 119. Inner body seal members 144 maintain a seal with inner body 127, while allowing a small gap to develop between the portion of body 132 axially above the upper inner body seal 144 and inner body 127. The fluid pressure then fills the small gap and pushes body 132 radially inward and downward, further against lower riser connector 113 and BOP flange 119. In this manner, the fluid pressure within the bore further sets seal 141, increasing the strength of the seal during operational use of connector assembly 111. In this manner, connector assembly 111 may seal to a subsea member having a bore without an attached flange using the internal pressure within bore 139.

Referring again to FIG. 1, outer body 29 has a lower engaging member that may be a plurality of lower dogs 51 or alternately segments of a ring, a collet, or some other device. In the illustrated embodiment, the lower engaging member has an engaged state configured to hold connector assembly 11 to BOP flange 19, and a disengaged state configured to not inhibit connector assembly 11 from movement onto and off of the lower riser connector 13 and BOP 21. Lower dogs 51 may be energized from the retracted position shown in FIG. 1 to an inward engaged position shown in FIGS. 10 and 11. In this example, lower dogs 51 are energized by a remote operated vehicle (ROV) that engages an ROV interface 53. The ROV may move lower dogs 51 inward by rotating a shaft or some other type of mechanism in ROV interface 53, such as supplying fluid pressure to a piston located within ROV interface 53. Alternately, lower dogs 51 could be spring-biased to the inward position. Furthermore, they could be controlled by hydraulic fluid pressure delivered from a surface vessel to connector assembly 11 via an umbilical or line (not shown).

Outer body 29 also has an upper engaging member that, in this example, comprises a set of upper dogs 55 located above lower dogs 51. In the illustrated embodiment, the upper engaging member is configured to alternately apply a load to or remove a load from inner body 27. Upper dogs 55 may alternately be segments of a ring, a collet, or some other device. Upper dogs 55 are located at the upper end of cavity 43 and will move from the retracted position shown in FIG. 1 to the inward engaging position shown in FIG. 11. Upper dogs 55 may be moved inward by an ROV engaging an ROV interface 59. ROV interface 59 may comprise a device that moves upper dogs 55 inward by rotating a screw mechanism. Alternately, the ROV could move upper dogs 55 inward by supplying hydraulic fluid to move them inward. In another embodiment, upper dogs 55 could be energized by a hydraulic fluid supply from a surface vessel. In yet another embodiment, upper dogs 55 could be spring-biased to the inward position.

A long guide pin 61 extends downward from a lower edge or rim 60 of inner body 27. Long guide pin 61 is a cylindrical member in this embodiment that may have a lower entry portion 62 of smaller diameter. Long guide pin 61 has its upper end fixed to inner body 27, such as by threads. Long guide pin 61 extends below outer body 29 even when outer body 29 is in its lower position.

A short guide pin 63 also secures to lower rim 60 of inner body 27. Short guide pin 63 is also a cylindrical member. It optionally may have a slightly larger diameter than long guide pin 61. Short guide pin 63 has a shorter length than long guide pin 63, but also protrudes below outer body 29 when outer body 29 is in the lower position. Short guide pin 63 may have a tapered nose. Short guide pin 63 is spaced for engaging one of the holes 25 in flange 17 after long guide pin 61 has engaged the other of the empty holes 25. In this example, the empty holes 25 are spaced 180° apart, thus guide pins 61 and 63 are 180° apart from each other relative to a longitudinal axis 65 of connector assembly 11. Guide pins 61 and 63 are parallel to a longitudinal axis 65 of connector assembly 11. A person skilled in the art will understand that alternative embodiments may not include guide pins 61 and 63.

A stop pin 67 is mounted to a lower edge or rim 69 of outer body 29. Stop pin 67 extends downward parallel to axis 65. Stop pin 67 is spaced farther from axis 65 than guide pins 61, 63 so that when guide pins 61, 63 are in flange holes 25, the side surface of stop pin 67 will be touching an outer diameter portion of flanges 17, 19. Stop pin 67 may have a length that is approximately the same as long guide pin 61 or it may differ. Stop pin 67 may be spaced circumferentially from both guide pins 61, 63, as in this example. A person skilled in the art will understand that alternative embodiments may not include stop pin 67.

An annular tapered surface or bevel 70 extends upward from an inner edge of rim 70 of outer body 29 and joins the cylindrical wall defining cavity 43. Stop pin 67 secures to a threaded hole in rim 69 radially outward from bevel 70.

Bracket 33 has a series of bolts 73 that extend upward for connecting connector assembly 11 to additional equipment. That equipment may include a valve block containing valves or a lower end of another riser. Further, the additional equipment may comprise a running tool for lowering connector assembly 11 on drill pipe or on a lift line.

In FIG. 1, axis 71 of riser connector 13 is oriented vertical. However, it may be tilted as shown FIGS. 7-8, which illustrate a tilt of approximately 4.6° from vertical. The tilting may be a result of damage to BOP 21 or to a subsea wellhead housing onto which BOP 21 is connected. Also, curved surface 18 of lower riser connector 13 leading from flange 17 to cut 15 may be generally symmetrical or it may be asymmetrical about axis 71. Damage may have occurred, causing the portion at cut 15 to be asymmetrical about axis 71. The center point at cut 15 may be offset laterally in one direction from axis 71. If the portion at cut 15 is symmetrical about axis 71, connector assembly 11 may be lowered onto lower riser connector 13 with its axis 65 generally aligned with riser connector axis 71. Preferably, whether or not the upper portion of riser connector 13 is symmetrical or asymmetrical, connector assembly 11 is oriented with its axis 65 vertical while being lowered onto riser connector 13. If lower riser connector axis 71 is vertical, connector axis 65 and riser connector axis 71 would coincide with each other while connector assembly 11 is only a short distance above riser connector 13. Even if lower riser connector axis 71 is tilted slightly, if cut 15 is generally symmetrical about axis 71, it may be possible to lower connector assembly 11 with its axis 65 generally centered on riser connector axis 71.

Figure 3:
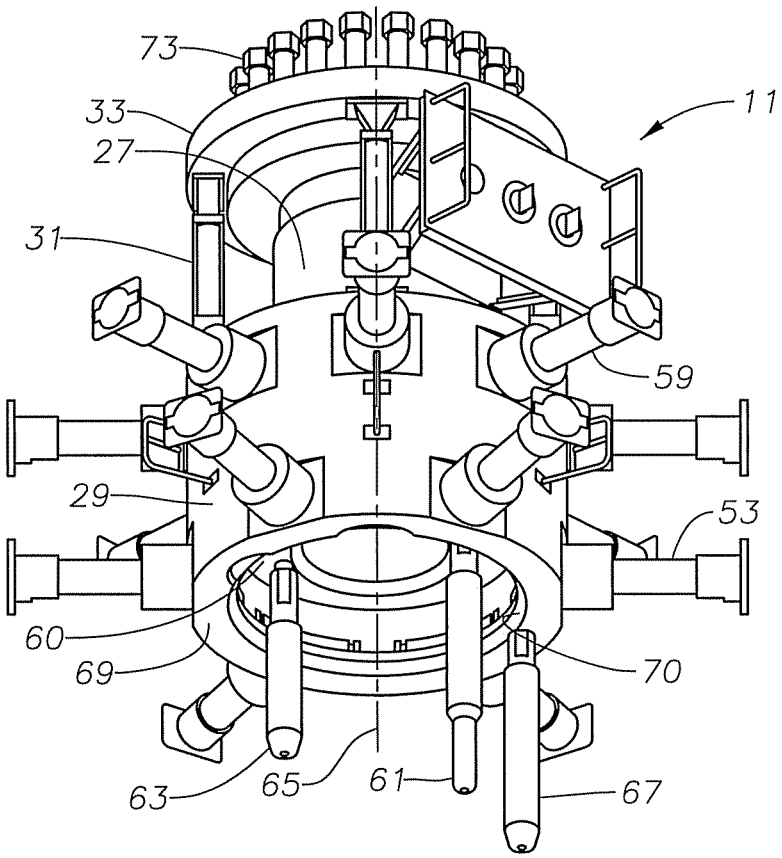
FIG. 3 is a perspective view illustrating the connector of FIG. 1.
Figure 5:
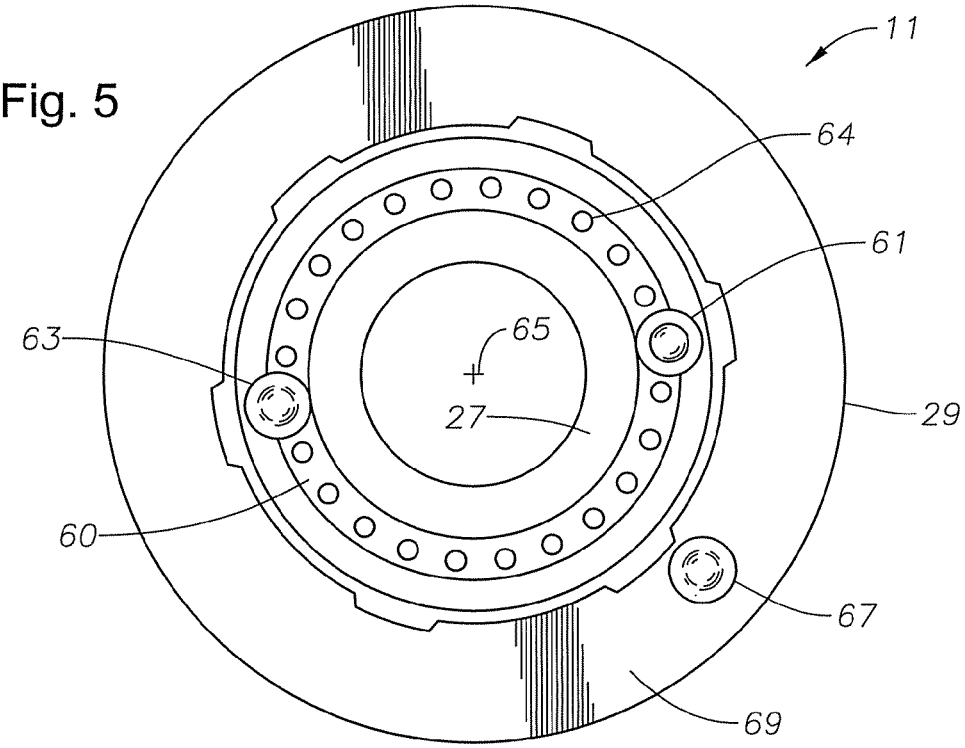
FIG. 5 is a bottom view of the connector as shown in FIG. 3.

For a riser connector 13 with a symmetrical portion at cut 15 relative to axis 71, guide pins 61, 63 are spaced concentrically relative to axis 65, as shown in FIGS. 3 and 5. Referring to FIG. 5, the radius from guide pin 61 to axis 65 is the same as the radius from guide pin 63 to axis 65. Stop pin 67 serves as a guide in the embodiment of FIGS. 3 and 5 by contacting the outer diameter of flanges 17, 19. Stop pin 67 is shown in FIG. 5 about 30 degrees from long guide pin 61 and 150 degrees from short guide pin 63, but other angles are possible. Preferably, guide pins 61, 63 are substantially aligned with their respective holes 25 before lowering guide pins 61, 63 into their respective holes 25. Long guide pin 61 first enters one of the holes 25, then continued lowering causes short guide pin 63 to enter its hole 25. Some rotation of connector assembly 11 may be required for this alignment to occur.

Figure 4:
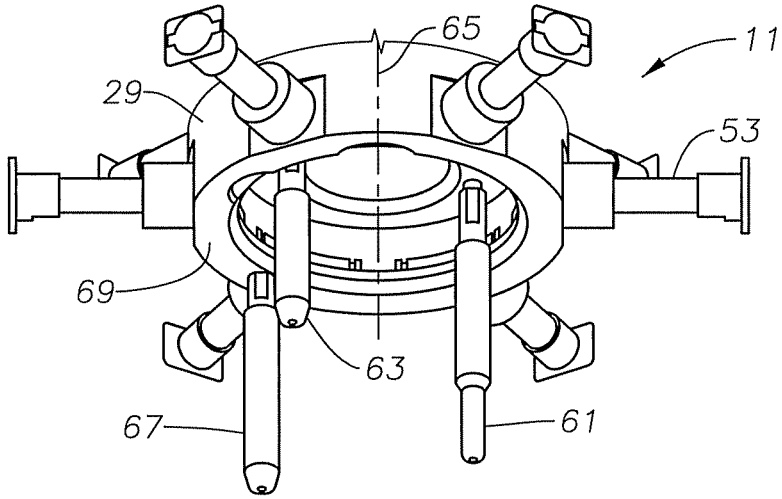
FIG. 4 is perspective View of a lower portion of the connector as shown in FIG. 3, but illustrating the guide pins and stop pin re-positioned for installation on a made-up flange that has an upper asymmetrical portion.
Figure 6:
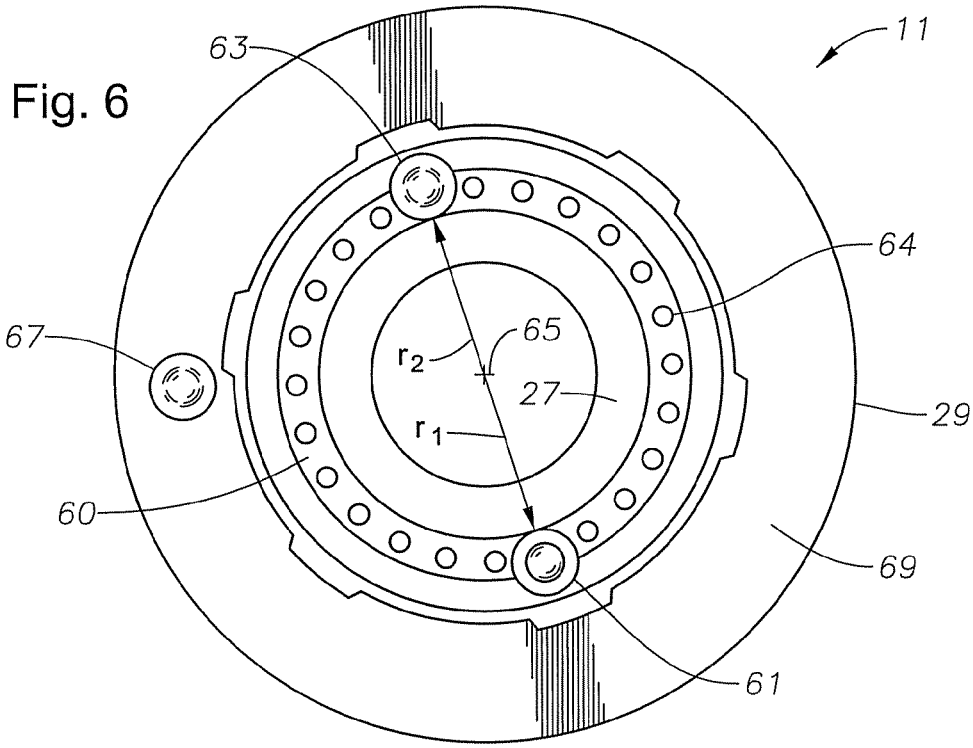
FIG. 6 is a bottom view of the connector as shown in FIG. 4.

If the portion of riser connector 13 adjacent cut 15 is asymmetrical, it may not be possible for guide pins 61, 63 to be aligned then lowered straight into holes 25. FIGS. 4 and 6 show an arrangement of guide pins 61, 63 and stop pin 67 that may be employed if riser connector 13 is asymmetrical relative to flange axis 71. Preferably, inner body 27 has a plurality of threaded holes 64 on its rim 60 for securing guide pins 61, 63. Some individual threaded holes 64 are at different radial distances from axis 65 than others. In FIG. 6, guide pins 61, 63 have been secured to different threaded holes 64 in rim 60 from FIG. 5, so that a point equidistant between guide pins 61, 63 will not coincide with connector assembly axis 65. Rather, a center point between guide pins 61, 63 will be slightly offset from axis 65. Long guide pin 61 is at a greater distance r1 to axis 65 than distance r2 of short guide pin 63 to axis 65. The distance r1 plus r2 between guide pins 61, 63 is still the same distance as between holes 25 (FIG. 1). The distance r2 is less than the distance from short pin 63 to axis 65 in FIG. 5. The distance r1 is greater than the distance from long pin 61 to axis 65 in FIG. 5. Stop pin 67 is about 70 degrees from short pin 63 and 110 degrees from long pin 61 in this example, but these angles could differ.

Figure 7:
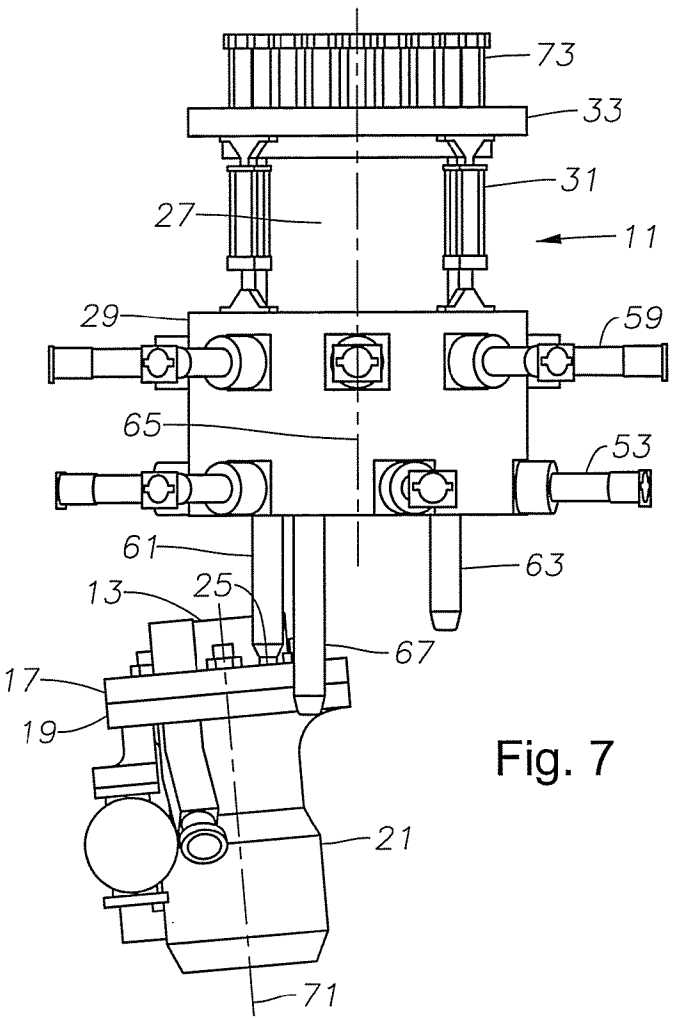
FIG. 7 is a perspective view of the connector configured as in FIG. 6, shown during a first step in engaging a made-up flange, which involves lowering a long guide pin through one of the holes in the made-up flange.

FIG. 7 illustrates a first step in installing connector assembly 11 on a tilted lower riser connector 13 with an asymmetrical upper portion. Connector assembly 11 has its axis 65 oriented vertically while being lowered subsea. Outer body 29 will be in its upper position relative to inner body 27, with guide pins 61, 63 protruding below the lower end of outer body 29. Long guide pin 61 is first stabbed a short distance into one of the holes 25. When this occurs, connector assembly 11 will be oriented so that its axis 65 is spaced laterally or outboard from flanges 17, 19. Short guide pin 63 will also be laterally spaced or outboard from flanges 17, 19, far out of alignment with its respective hole 25. Long guide pin 61 will only enter an upper portion of its hole 25 so that the lower end of short guide pin 63 is at a higher elevation than the upper flat surface of riser flange 17. The lower end of short guide pin 63 need not be at an elevation higher than severed upper end 15 (FIG. 1) because it will swing around the asymmetrical portion of lower riser connector 13 during the next step. Preferably, an ROV with a video camera will be in assistance. A paint mark (not shown) on long guide pin 61 will indicate to the ROV operator in a surface vessel when the proper amount of penetration in hole 25 has occurred.

Figure 8:
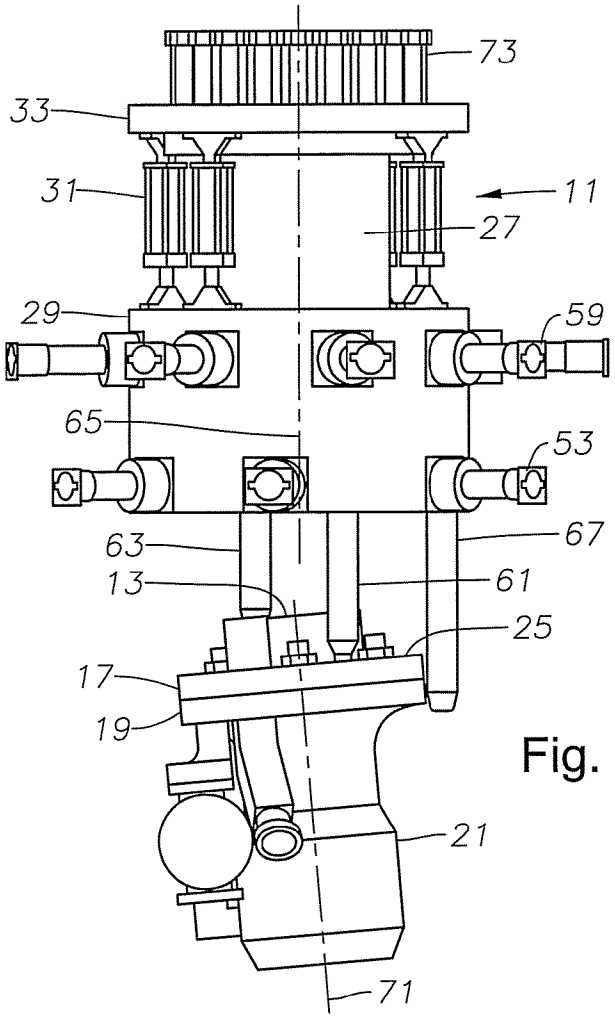
FIG. 8 is a perspective view similar to FIG. 7, illustrating a second step, which involves rotating the connector.

Referring to FIG. 8, the operator then rotates connector assembly 11 about long guide pin 61. In this example, the rotation is counterclockwise while looking down on connector assembly 11. The rotation will be around the hole 25 receiving long guide pin 61, not around connector assembly axis 65. The degree of rotation is the amount that is required to swing stop pin 67 around until it bumps against the outer diameter of flanges 17 and 19. The amount of rotation will be less than 360 degrees and will depend on the position of stop pin 67 when long guide pin 61 enters hole 25. Stop pin 67 is positioned relative to guide pins 61, 63 so that when stop pin 67 bumps against the outer diameter of flanges 17, 19, short guide pin 63 will be aligned above the other hole 25 (not shown). FIG. 8 illustrates stop pin 67 bumping against flanges 17, 19, and short guide pin 63 aligned with the other of the holes 25. The offset positions of guide pins 61, 63 relative to axis 65 will position connector axis 65 offset from lower riser connector axis 71 at this point.

Figure 9:
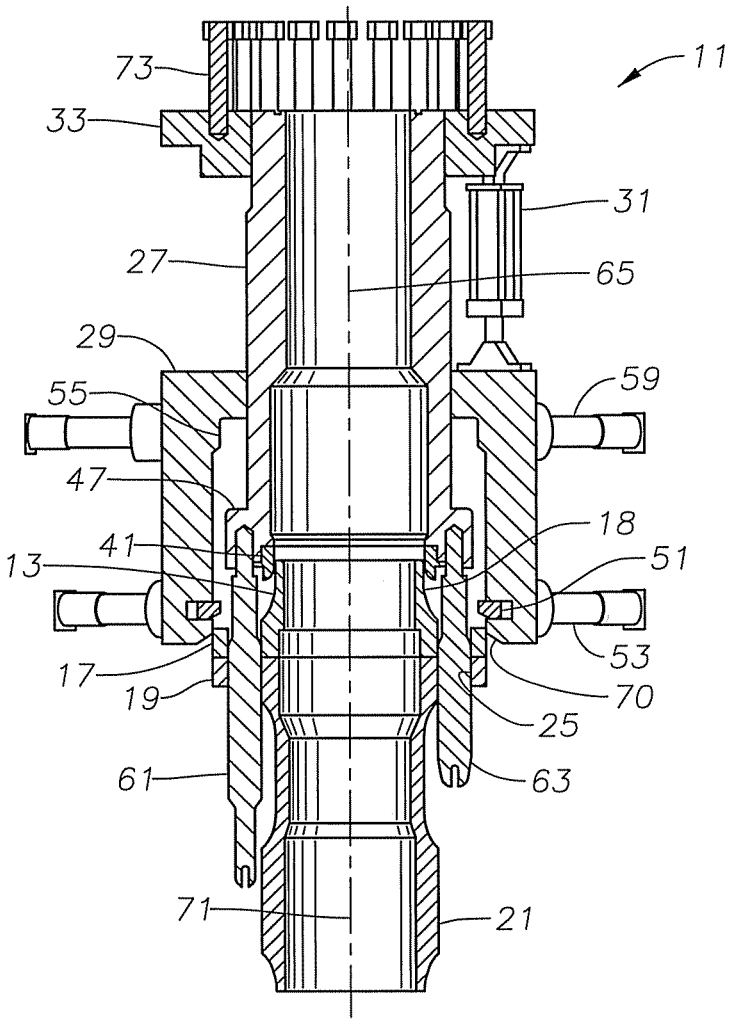
FIG. 9 is a sectional view of the connector and made-up flange of FIG. 7, illustrating a third step, which involves lowering both guide pins through holes in the made-up flange.

The operator then lowers connector assembly 11, which causes guide pins 61, 63 to move downward in their respective holes 25. Lowering connector assembly 11 also causes axis 65 of connector assembly 11 to tilt and align with the tilted inclination of lower riser connector 13. As connector assembly 11 moves downward, the offset in axis 65 relative to axis 71 allows seal 41 (FIG. 1) to clear the laterally protruding upper portion of lower riser connector 13. FIG. 9 shows seal 41 in close proximity, but not yet landed on lower riser connector 13. Bevel 70 on lower rim 69 of outer body 29 will be engaging riser flange 17 before seal 41 touches riser connector 13 (not shown in FIG. 9). Outer body 29 will still be in the upper position relative to inner body 27. The inner diameter of outer body 29 at bevel 70 is only slightly larger in diameter than riser flange 17, thus bevel 70 will cause connector assembly 11 to move slightly laterally from the offset position to an aligned position wherein axis 65 coincides with axis 71. Guide pins 61, 63 are slightly smaller than their respective guide holes 25 to allow this lateral shifting to occur. Once axes 65, 71 are aligned, seal 41 will land on curved surface 18. Another paint line (not shown) on long guide pin 61 will indicate when seal 41 has properly landed on curved surface 18. When seal 41 has properly landed, each guide pin 61, 63 will be slightly offset in its respective flange hole 25.

Figure 10:
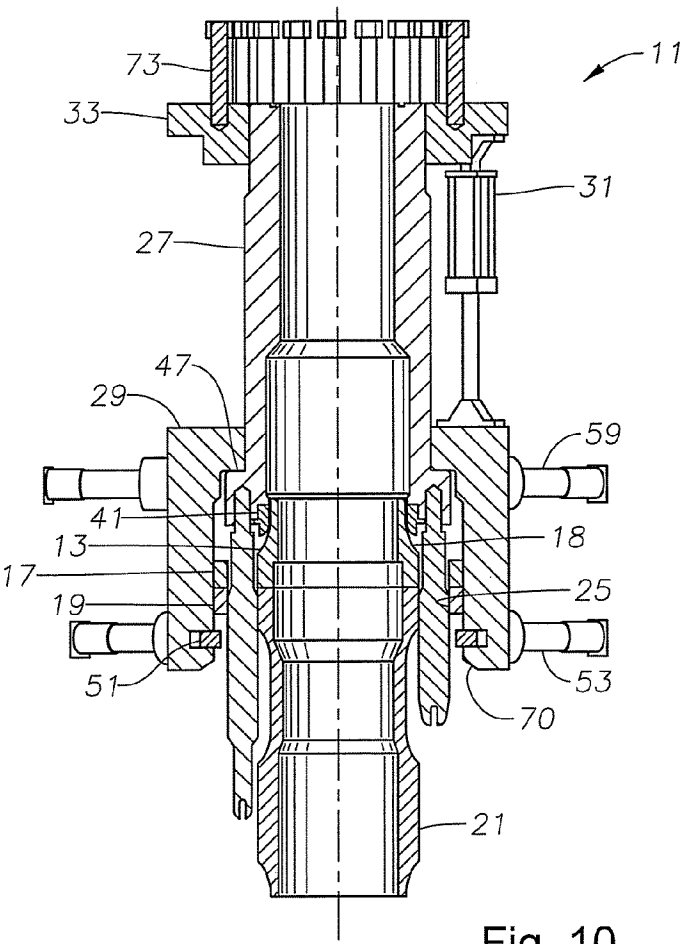
FIG. 10 is a sectional view similar to FIG. 9, illustrating a fourth step, which involves stroking the outer body of the connector downward relative to the inner body and stroking the lower dogs.

Referring to FIG. 10, the operator then applies fluid pressure to hydraulic cylinders 31 to stroke outer body 29 downward relative to inner body 27, which is now aligned and resting on lower riser connector 13. While outer body 29 is in its lowest position relative to inner body 27, lower dogs 51 will be located at a lower elevation than the lower side of BOP flange 19. The operator then strokes lower dogs 51 inward by engaging ROV interfaces 53. Preferably, lower dogs 51 will be spaced a short distance below the lower side of BOP flange 19 once in the inward positions.

Figure 11:
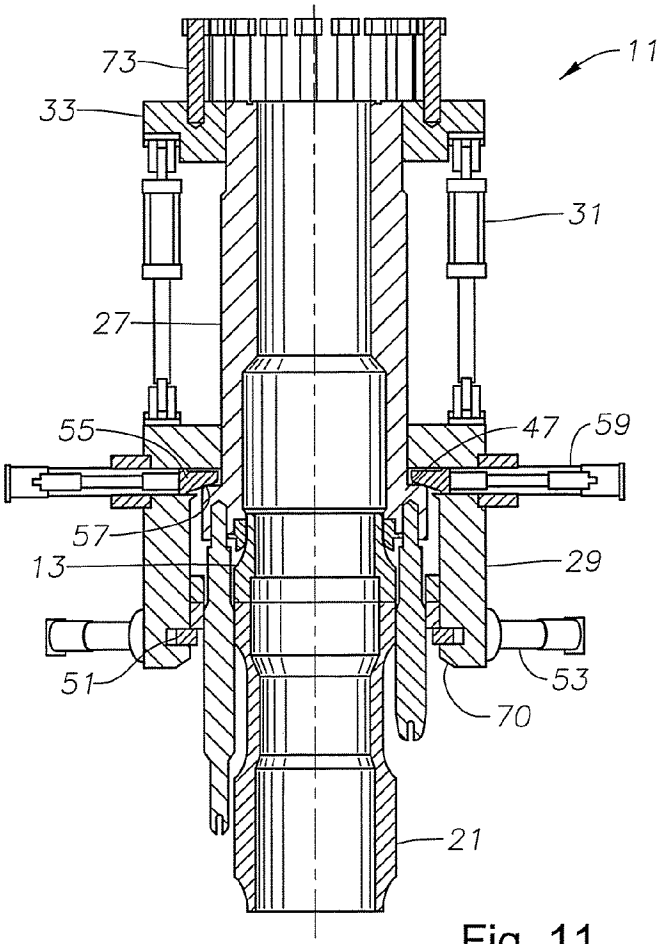
FIG. 11 is a sectional view similar to FIG. 10, illustrating a fifth step, which involves moving upper dogs inward.

Then, the operator will employ hydraulic cylinders 31 to lift outer body 29 relative to inner body 27 a short distance until lower dogs 51 abut the lower side of BOP flange 19. The operator will then stroke upper dogs 55 inward as shown in FIG. 11. The lower surfaces 57 of upper dogs 55 will engage upward facing shoulder 47, pushing downward on flange 45 and inner body 27 and pulling upward on outer body 29. The engagement of upper dogs 55 with upward facing shoulder 47 causes a preload force to occur that lower dogs 51 react to by engaging the lower sides of BOP flange 19. The application of the preload force forms a tight seal between seal 41 and curved surface 18. Guide pins 61, 63 aren't shown in FIGS. 10 and 11, but will remain in their respective holes 25. If needed, a sealant can be injected through a port (not shown) in connector assembly 11 between curved surface 18 and the area around seal 41. Any fluid flowing up through lower riser connector 13 will thus flow into inner body bore 39 where it may be delivered to the surface or otherwise contained.

As fluid flows up through lower riser connector 13 into bore 39, the internal pressure created by the movement of the fluid may cause movement of connector assembly 11 relative to lower riser connector 13. As described above with respect to FIGS. 2A-2E, seal 41 will float relative to connector assembly 11 and move axially such that the inner body seal members 44 and the elastomeric seal members 36, 46 will maintain the tight seal between inner body 29 and lower riser connector 13. In this manner, the fluid flow through bore 39 pressure energizes seal 41.

It may be possible to disconnect lower riser flange 17 from BOP flange 19 before running connector assembly 11 as illustrated in FIG. 2E. If so, connector assembly 11 could land on and connect to BOP flange 119 employing lower dogs 51 and upper dogs 55 as described above with respect to FIGS. 3-11. Seal 141 then seals against the upper surface of BOP flange 119 and an exterior surface of lower riser connector 113 as described above with respect to FIG. 2E. Cap assembly 11 will operate to energize the seal as described above with respect to FIGS. 9-11. In this embodiment, seal 141 has an axial length sufficient to extend from a lower surface of inner body 127 to BOP flange 119. The concentric arrangement of guide pins 61, 63 shown in FIG. 5 could be employed or alternatively not used at all.

While described in connection with a blowout preventer and lower riser connector, the invention is also applicable to connecting to other types of made-up flanges or connection points.

By the use of the present invention, a subsea device may be connected to and sealed using the internal pressure of the device. Thus, the seal disclosed herein is energized in a manner that overcomes the differential pressure problems of prior art connectors by using the differential pressure to energize and maintain the seal.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A connector for connecting to a subsea device having an axis, the connector comprising:

an outer body defining a cavity;

an inner body defining a bore, wherein the lower end of the inner body resides within the cavity;

an engaging member coupled to the outer body and configured to engage a shoulder of the subsea device, the engaging member being configured to move radially between a radially withdrawn position disengaged from the subsea device and radially advanced position engaging the subsea device;

a seal carried by the inner body and configured to form a seal between the inner body and the subsea device;

a pre-loading member coupled to the outer body, the pre-loading member being configured to engage a shoulder of the inner body, the pre-loading member being configured to move radially between a radially withdrawn position disengaged from the inner body and a radially advanced position engaging the inner body and urging the seal against the subsea device to exert a pre-loading force on the seal; and wherein the seal is configured to be further energized by a pressure of a fluid flowing through the bore.

2. The connector of claim 1, wherein:

the seal couples to a lower rim of the bore of the inner body; and wherein the seal is configured to move axially along the axis relative to the inner body.

3. The connector of claim 2, wherein the seal is configured to move axially in response to the pressure of the fluid flowing through the bore.

4. The connector of claim 3, wherein the seal comprises:

a metal body having a curved lower portion; and a flange that secures the seal to the inner body.

5. The connector of claim 4, wherein:

the curved lower portion of the seal includes a recess; and an elastomeric member is seated in the recess and is configured to engage the subsea device.

6. The connector of claim 4, wherein:

the curved lower portion includes a recess; and a soft metal member is seated in the recess and is configured to engage the subsea device.

7. The connector of claim 4, wherein the seal further comprises an elastomeric member bonded to an exterior of the curved lower portion and configured to engage the subsea device.

8. The connector of claim 3, further comprising:

a coupler ring coupled to the lower rim of the inner body; and a sealing ring configured to move axially upward and downward relative to the coupler ring;

wherein the coupler ring is configured to couple the sealing ring to the lower rim of the inner body.

9. The connector of claim 8, wherein the sealing ring includes a recess; and wherein a seal member seated in the recess is configured to engage the inner body.

10. The apparatus of claim 8, wherein the sealing ring includes a recess; and wherein a seal member is seated in the recess is configured to engage the subsea device.

11. The apparatus of claim 8, wherein:

the coupler ring defines an inner annular protrusion extending radially toward the bore;

the inner annular protrusion of the coupler ring defines an annular space between the inner annular protrusion and the lower rim of the inner body proximate to the bore;

the sealing ring defines an outer annular protrusion extending radially away from the bore; and the outer annular protrusion of the scaling ring inserts into the annular space between the inner annular protrusion and the lower rim of the inner body.

12. A method for connecting to a subsea device, the method comprising:

(a) providing a connector including:

an outer body defining a cavity;

an inner body defining a bore, wherein a lower end of the inner body resides within the cavity;

an engaging member coupled to the outer body;

a seal carried by the inner body; and a pre-loading member coupled to the outer body;

(b) lowering the connector toward the subsea device and inserting an upper end of the subsea device into the cavity;

(c) energizing the engaging member to engage the subsea device;

(d) energizing the pre-loading member to engage the inner body;

(e) exerting a preload force in the seal during (d); and (f) pressure energizing the seal with a fluid flowing through the bore;

wherein step (f) comprises:

passing a fluid from the subsea device through the bore creating a fluid pressure within the bore; and causing the connector to move axially relative to the subsea device in response to the fluid pressure within the bore.

13. The method of claim 12, wherein step (c) comprises engaging a downward facing surface of the subsea device.

14. The method of claim 12, wherein step (d) comprises engaging an upward facing surface of the inner body.

15. The method of claim 12, wherein step (f) comprises:

passing a fluid from the subsea device through the bore creating a fluid pressure within the bore;

moving the connector axially relative to the seal; and causing the seal to further set against the subsea device.

* * * * *